US007793866B2

(12) United States Patent
Chou

(10) Patent No.: US 7,793,866 B2
(45) Date of Patent: Sep. 14, 2010

(54) PERFUME SPRAY HEAD WITH LEAKPROOF FEATURE

(76) Inventor: Chin-Hsing Chou, No. 130, Singdong St., Lioujia Township, Tainan County 734 (TW)

( * ) Notice: Subject to any disclaimer, the term of this patent is extended or adjusted under 35 U.S.C. 154(b) by 154 days.

(21) Appl. No.: 12/285,841

(22) Filed: Oct. 15, 2008

(65) Prior Publication Data

US 2010/0090029 A1 Apr. 15, 2010

(51) Int. Cl.
*B05B 7/30* (2006.01)

(52) U.S. Cl. ..... 239/354; 239/355; 239/362; 239/363; 239/581.1

(58) Field of Classification Search ..... 239/349, 239/354, 355, 361–363, 369–371, 579, 581.1
See application file for complete search history.

(56) References Cited

U.S. PATENT DOCUMENTS 1,090,863 A * 3/1914 Kelley ..... 137/255
1,877,252 A * 9/1932 Patou ..... 239/363
1,979,455 A * 11/1934 Custer et al. ..... 239/353
2,014,671 A * 9/1935 Rothe ..... 239/362
2,016,544 A * 10/1935 Daggett ..... 239/353
2,629,631 A * 2/1953 Reginald ..... 239/361
2,665,170 A * 1/1954 Schmitt et al. ..... 239/353
2,755,131 A * 7/1956 Croce ..... 239/73
2,755,132 A * 7/1956 Croce ..... 239/353
2,779,628 A * 1/1957 Croce ..... 239/353
2,837,374 A * 6/1958 Lipman ..... 239/354
2,868,586 A * 1/1959 Croce ..... 239/362
3,082,959 A * 3/1963 Boris ..... 239/329
7,559,441 B2 * 7/2009 Yu ..... 222/183

* cited by examiner

*Primary Examiner*—Christopher S Kim
(74) *Attorney, Agent, or Firm*—Rosenberg Klein & Lee

(57) ABSTRACT

The present invention provides a perfume spray head with leakproof feature comprising a spraying unit and an annular pad, wherein spraying unit has a holding groove with an aerator, a nozzle and a 1 flow passage, a protrudent docking stem with a locking dented ring as well as a curved anchoring trough and an air inlet, and annular pad has an anchoring hole with an anchoring pin, a docking pit, a perforated positioning hole with a positioning and locking pin, an air intake passage and a flow path connected with a liquid feeding channel, as well as a coupling bushing; Thereby, the spray head is switched into "ON status" or "OFF status" when the spraying unit is turned to the position where the flow passage in or out of alignment with the flow path so that effects in component simplification, assembly easiness and cost reduction are achieved.

5 Claims, 9 Drawing Sheets

A-A

A-A

B-B

C-C

D-D

PERFUME SPRAY HEAD WITH LEAKPROOF FEATURE

TECHNICAL FIELD OF THE INVENTION

The present invention provides a perfume spray head with leakproof feature, particularly for one that the spray head can be switched into "ON status" or "OFF status" by turning the spraying unit to the position where the flow passage in or out of alignment with the flow path so that effects in component simplification, assembly easiness and cost reduction are achieved.

BACKGROUND OF THE INVENTION

Generally, the principle of the conventional atomized perfume bottle is to well mix the liquid perfume and air in the spray head and to eject it out of the nozzle in atomized effect, wherein the liquid perfume is sucked upwards along the internal liquid feeding channel while the air is come from the air inflator, which is squeezed by the user. By long term investigation, the liquid perfume in the bottle assembled leaks easily in overflow manner in consequence of being upwards risen in the liquid feeding channel due to pressure increasing by the ambient heating temperature during transportation so that it is reckoned as defective product for lack of adequate perfume quantity. In order to solve the issue aforesaid, some industrial businesses get into the study for improving the structure of the conventional perfume bottle and result in certain new models of leakproof perfume bottle continually being introduced such as the Taiwan New Model Patents in numbers of M274839 and M310185. However, after profound research the structure of the introduced new perfume bottle, the inventor of the present invention finds that many trivial tiny components are added to increase the complication of the structure and the difficulty in the fabricating process so that the improvement in the leakproof is at a price, which sacrifices the manufacturing cost and the assembly convenience. Thus, they are not an ideal good products. Having realized and addressed the foregoing issues and drawbacks in the conventional perfume bottle, the inventor of the present invention undertakes a focusing and painstaking research and study through constantly design, test and improvement for a long time. Eventually the perfume spray head with leakproof feature of present invention is successfully worked out.

SUMMARY OF THE INVENTION

The primary object of the present invention is to provide a perfume spray head with leakproof feature comprising a spraying unit and an annular pad, wherein the spraying unit has an internal horizontal holding groove with an inside aerator, a horizontal nozzle and a vertical flow passage created therein, a protrudent docking stem with a locking dented ring disposed at the central bottom side thereof as well as a curved anchoring trough and an air inlet configured at the bottom side thereof, wherein the nozzle is formed at the front end of the spraying unit, the vertical flow passage is created inside of the spraying unit, the curved anchoring trough is dented along the inside margin at the bottom side of the spraying unit, and the air inlet is configured at the rear end of the spraying unit in opposite corresponding with the nozzle; and the annular pad has an anchoring hole with an inside anchoring pin created on the top side thereof, a docking pit created in the central top side thereof, a perforated positioning hole with an inside positioning and locking pin disposed at the lateral wall thereof in connection with the docking pit, a vertical air intake passage and a vertical flow path connected with a liquid feeding channel created inside thereof, as well as a coupling bushing disposed at the bottom side thereof, wherein the anchoring pin inserts into the anchoring hole with its top end protruding outside, the docking pit is served for accommodating the protrudent docking stem, the flow path is connected with downward liquid feeding channel, and the vertical air intake passage is created between the anchoring pin and the flow path such that its open top end joints with the curved anchoring trough while its lower end is connected with the inside of the coupling bushing; By combination of the spraying unit and annular pad, the spray head is switched into "ON status" when the spraying unit is turned to the position where the flow passage of the spraying unit is in alignment with the flow path of the annular pad, while the spray head is switched into "OFF status" when the spraying unit is turned to the position where the flow passage of the spraying unit is out of alignment with the flow path of the annular pad.

The perfume spray head with leakproof feature accords with aforesaid one, wherein the curved anchoring trough is dented along the inside margin at the bottom side of the spraying unit with an included angle of 90° to the central axis.

The perfume spray head with leakproof feature accords with aforesaid one, wherein in the annular pad, on the peripherals of the top side and the bottom side thereof, on the inlet peripheral of the flow path as well as on the top end peripheral of the air intake passage, a leakage-proof washer are inset respectively; particularly at the included angle 90° position away the inlet of the flow path, where the flow passage is turned out of alignment with the flow path, a leakage-proof washer insets thereon.

The perfume spray head with leakproof feature accords with aforesaid one, wherein beneath the bottom side of the annular pad is further disposed a mounting cap, which has a mark "ON" and a mark "OFF" engraved on the top surface thereof with an included angle of 90° to the central axis in corresponding to the two end anchoring positions of the curved anchoring trough.

The perfume spray head with leakproof feature accords with aforesaid one, wherein a liquid feeding tube is further disposed in the inner top wall of the annular pad; and in the inner wall of the liquid feeding channel is further created an internal female thread for being forcibly driven into therein by the liquid feeding tube in combination manner.

DETAILED DESCRIPTION OF THE PREFERRED EMBODIMENT

Figure 1:
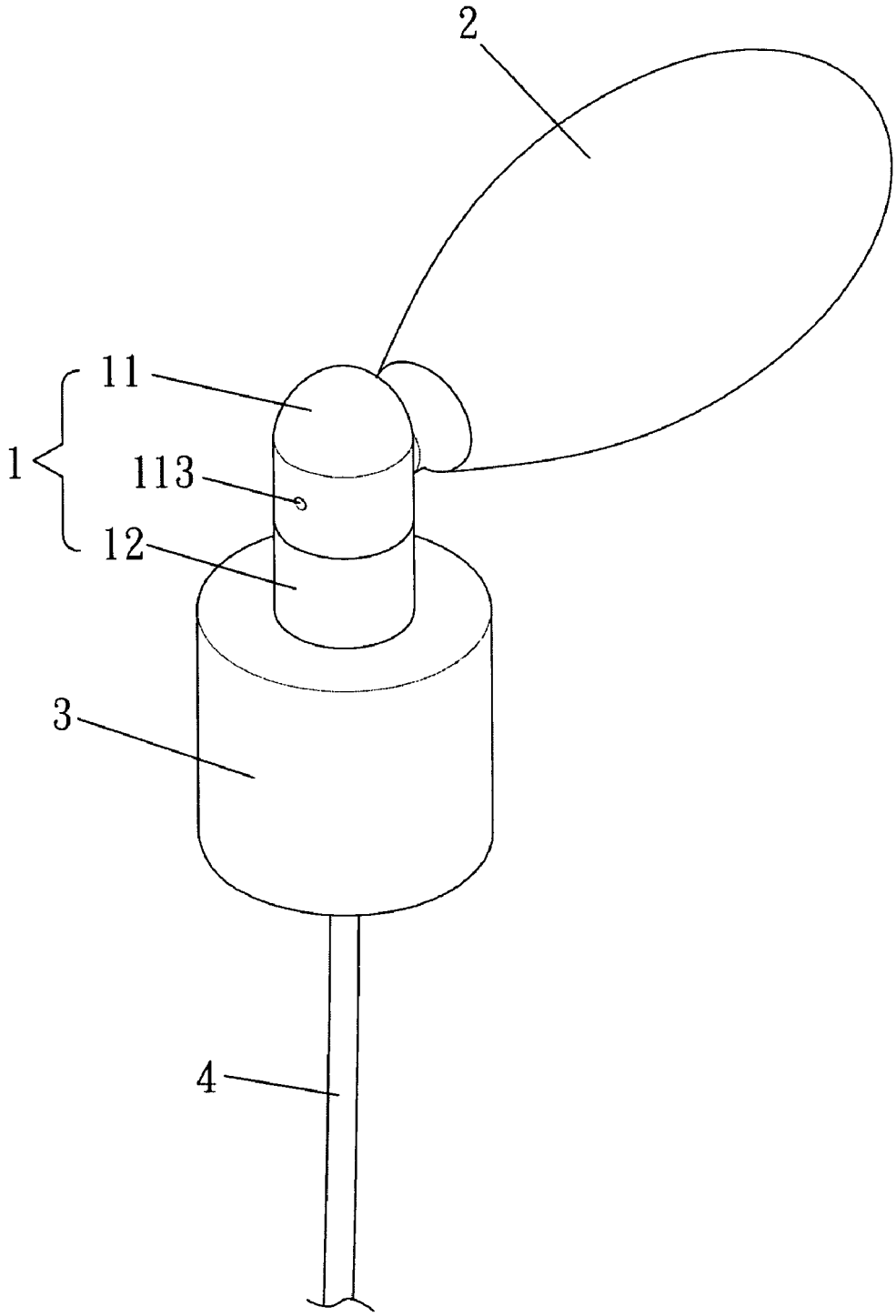
FIG. 1 is the perspective outward appearance view of the present invention.

Regarding the technical means of the inventor, we here present a preferred exemplary embodiment with associated drawings to describe in detail manner for your better perusal, understanding and recognizing the present invention. Firstly, please refer to FIGS. 1 and 2. FIG. 1 is the perspective outward appearance view of the present invention while FIG. 2 is the perspective exploded schematic view of the present invention.

Figure 2:
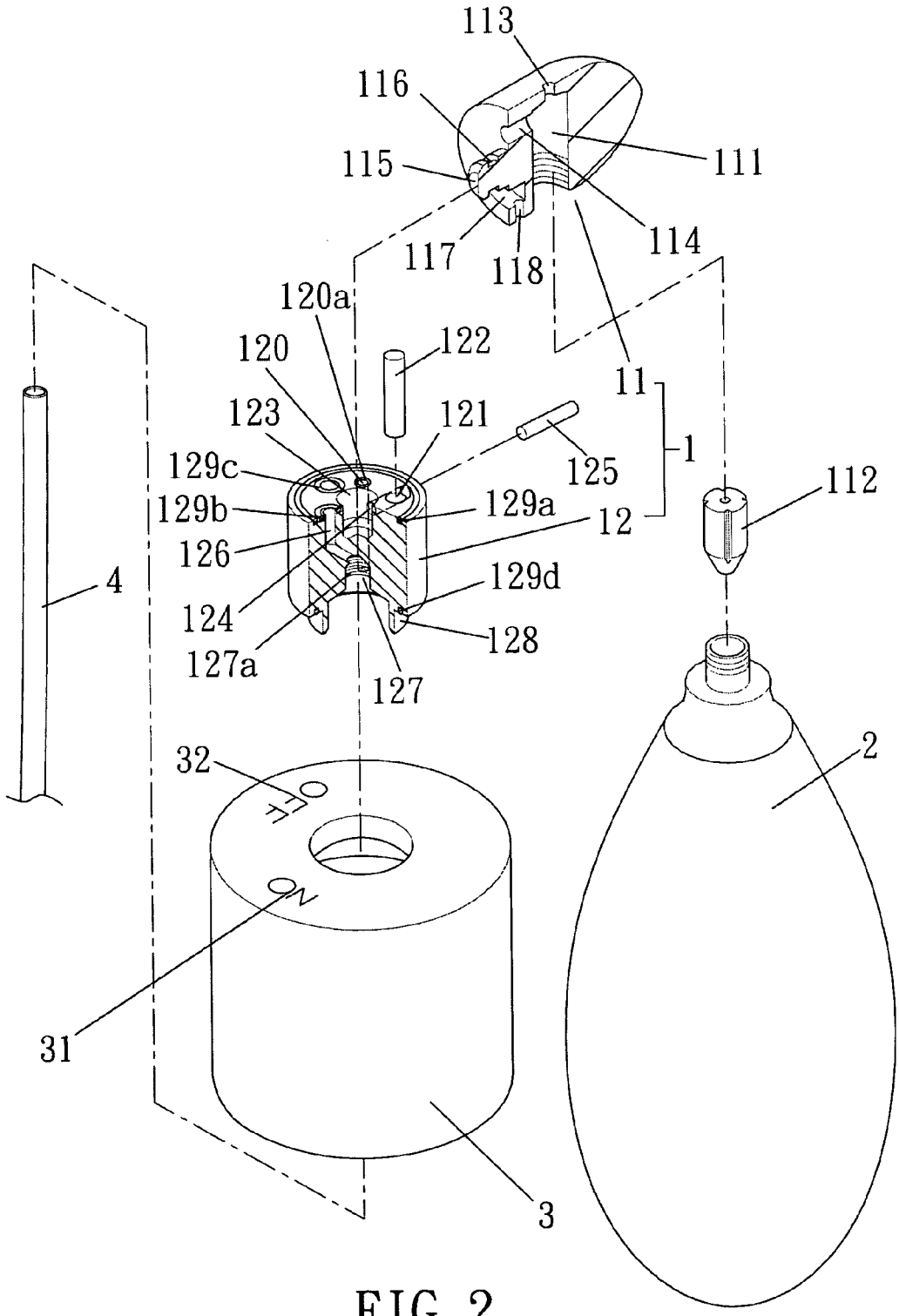
FIG. 2 is the perspective exploded schematic view of the present invention.

The "perfume spray head with leakproof feature" of the present invention comprises an oval-shaped air inflator 2, a mounting cap 3, a plastic liquid feeding tube 4 and a spray head 1, which includes a metal spraying unit 1 1 and an annular pad 12, wherein, As shown in the FIGS. 1 and 2, the spraying unit 11, which is made of metal material, has an internal horizontal holding groove 111 with an inside aerator 112, a horizontal nozzle 113 and a vertical flow passage 114 created therein, a protrudent docking stem 115 with a locking dented ring 116 disposed at the central bottom side thereof as well as a curved anchoring trough 117 and an air inlet 118 configured at the bottom side thereof, wherein the holding groove 111 is served to latch with the oval-shaped air inflator 2 so that the air in the oval-shaped air inflator 2 can be squeezed into the spraying unit 11, the aerator 112 is disposed in the holding groove 111 for directing and constricting the air from the oval-shaped air inflator 2 to enhance the Venturi effect, the nozzle 113 is formed at the front end of the spraying unit 11 in contact with ambient air for spraying atomized liquid perfume, the vertical flow passage 114 is created inside of the spraying unit 11 such that its top end is joint with the holding groove 111 while its lower end is open at the bottom side of the spraying unit 11 for connecting with another vertical flow path 126 in the annular pad 12 in selectively switching manner, which is going to be described below, the protrudent docking stem 115 with locking dented ring 116 is served for docking and locking the holding groove 111 with a docking pit 123 on the annular pad 12 in alignment manner, which is going to be described below, the curved anchoring trough 117 is dented along the inside margin at the bottom side of the spraying unit 11 with an included angle of 90° to the central axis for restricting movement of a anchoring pin 122 in the annular pad 12 between two end anchoring positions in confinement manner, which is going to be described below, and the air inlet 118 is configured at the rear end of the spraying unit 11 in opposite corresponding with the nozzle 113 to communicate with an air intake passage 120 in the annular pad 12 via the curved anchoring trough 117 for allowing ambient air entering in specific condition, which is going to be described below;

As shown in the FIGS. 1 and 2, the annular pad 12, which is made of metal material, has an anchoring hole 121 with an inside anchoring pin 122 created on the top side thereof, a docking pit 123 created in the central top side thereof, a perforated positioning hole 124 with an inside positioning and locking pin 125 disposed at the lateral wall thereof in connection with the docking pit 123, a vertical air intake passage 120 and a vertical flow path 126 connected with a liquid feeding channel 127 created inside thereof, as well as a coupling bushing 128 disposed at the bottom side thereof for jointing with the mounting cap 3 in combination manner, wherein the anchoring pin 122 inserts into the anchoring hole 121 with its top end protruding outside for being able to move between two end anchoring positions of the corresponding curved anchoring trough 117 on the spraying unit 11 in confinement manner, which is going to be described below, the docking pit 123 is served for accommodating the protrudent docking stem 115 on the spraying unit 11 in engagement manner, the front end of the positioning and locking pin 125 in the perforated positioning hole 124 projects into the docking pit 123 for inserting into a corresponding dent on the locking dented ring 116 in locking manner, the open top end of the flow path 126 serves for connecting with the flow passage 114 in the spraying unit 11 in selectively switching manner, which is going to be described below, while the lower end of the flow path 126 is connected with downward liquid feeding channel 127, on the central top inner wall of the liquid feeding channel 127 has an internal female thread 127*a* created therein for coupling with the plastic liquid feeding tube 4 in engagement manner; Moreover, in the annular pad 12, on the peripherals of the top side and the bottom side thereof, on the inlet peripheral of the flow path 126, a leakage-proof washer 129*a* and a leakage-proof washer 129*d* as well as a leakage-proof washer 129*b* are inset respectively; Besides, the vertical air intake passage 120 is created between the leakage-proof washer 129*c* and the anchoring pin 122 on the annular pad 12 such that its open top end communicates with the air inlet 118 in the spraying unit 11 via the curved anchoring trough 117 in specific condition, which is going to be described below, while its lower end is connected with the liquid feeding channel 127 in the annular pad 12, wherein a leakage-proof washer 120*a* is inset on the top end peripheral of the air intake passage 120; Particularly at the included angle 90° position away the inlet of the flow path 126, where the flow passage 114 in the spraying unit 11 is turned out of alignment with the flow path 126 in the annular pad 12, a leakage-proof washer 129*c* insets thereon to prevent the liquid perfume from leakage due to heating expansion or shaking influence in the transportation, which is going to be described in the following operation section;

As shown in the FIGS. 1 and 2, the mounting cap 3 has a mark "ON" 31 and a mark "OFF" 32 engraved on the top surface thereof with an included angle of 90° to the central axis in corresponding to the two end anchoring positions of the curved anchoring trough 117; and the liquid feeding tube 4, which is disposed in the inner top wall of the annular pad, is made of plastic material such that its lower end is vertically immersed in the liquid perfume, which is contained in the perfume bottle (not shown in the figures) while its top end, in spite of no outer male thread thereon, is forcibly driven into the internal female thread 127*a* of the annular pad 12 due to plastic pliability thereof to the rigid metal of the annular pad 12.

Figure 3:
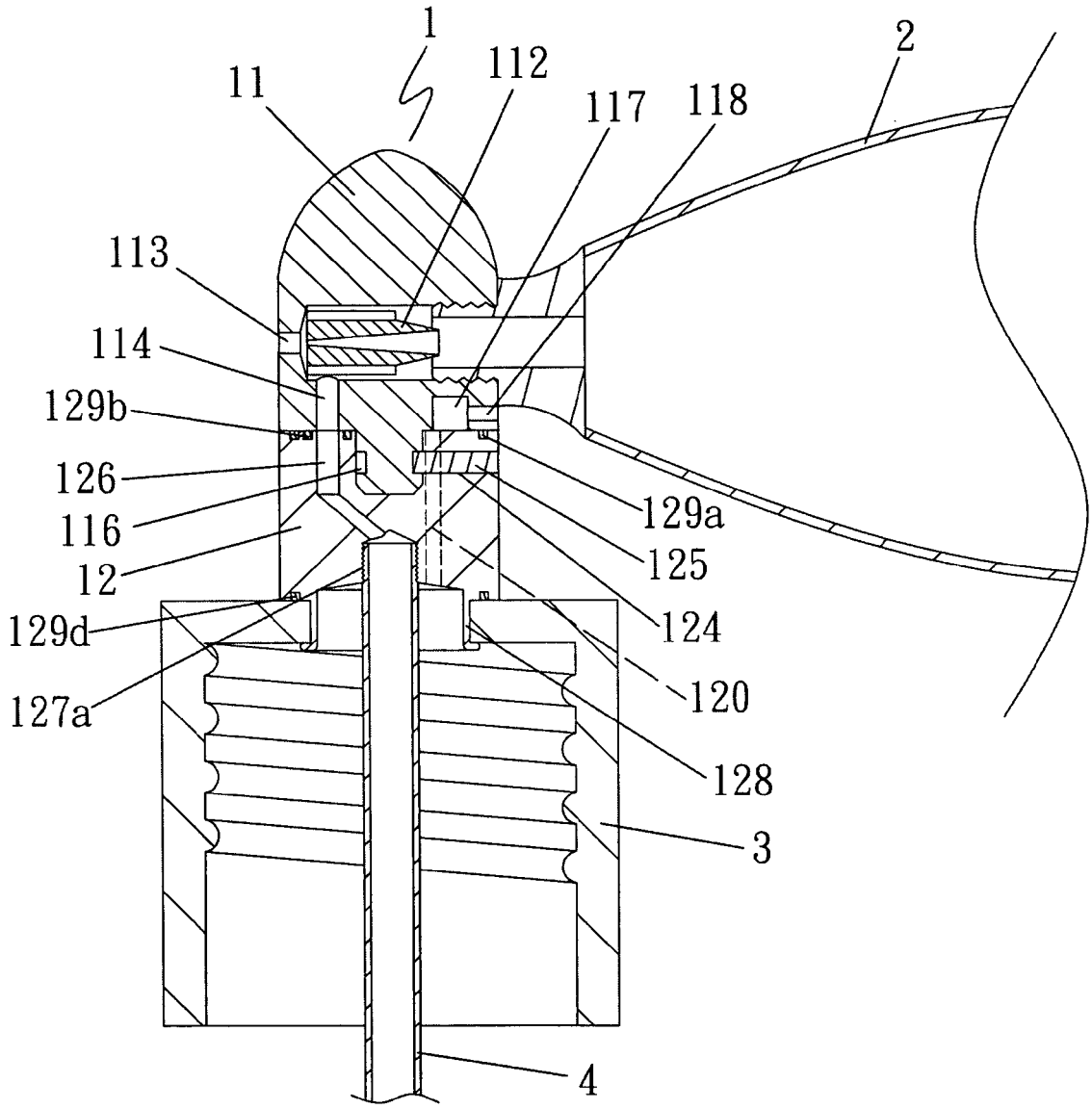
FIG. 3 is the cross section schematic view showing the assembly of the present invention.

Regarding the assembly for the "perfume spray head with leakproof feature" of the present invention, please refer to the FIGS. 1 and 3.

Firstly, let the anchoring pin 122 insert into the anchoring hole 121 in the annular pad 12, and rotate the spraying unit 11 up to the position where the curved anchoring trough 117 in alignment with the anchoring pin 122 of the annular pad 12, then load the protrudent docking stem 115 of the spraying unit 11 into the docking pit 123 of the annular pad 12 in proper docking manner so that the anchoring pin 122 of the annular pad 12 securely harbors in the curved anchoring trough 117 of the spraying unit 11 in proper anchoring manner;

Secondly, run the positioning and locking pin 125 through the perforated positioning hole 124 on the annular pad 12 to let its front end being inserted into the corresponding dent of the locking dented ring 116 so that the spraying unit 11 and annular pad 12 are completely docked together into the spray head 1 as shown in the figures;

Thirdly, fix the spray head 1 onto the mounting cap 3 via coupling bushing 128 in unity manner; and Finally, forcefully drive the plastic liquid feeding tube 4 into the liquid feeding channel 127 of the metal annular pad 12 so that the top outer end of the liquid feeding tube 4 is securely engaged with the internal female thread 127*a* of the liquid feeding channel 127 to prevent it from dropping off.

By means of the foregoing contrivances, the spray head 1 can be switched into "ON status" or "OFF status" by simply turning the spraying unit 11 of the spray head 1 by the user up to the position where the nozzle 113 in alignment with the mark "ON" 31 on the mounting cap 3 or the position where the nozzle 113 in alignment with the mark "OFF" 32 on the mounting cap 3 in the operation procedure.

Figure 4:
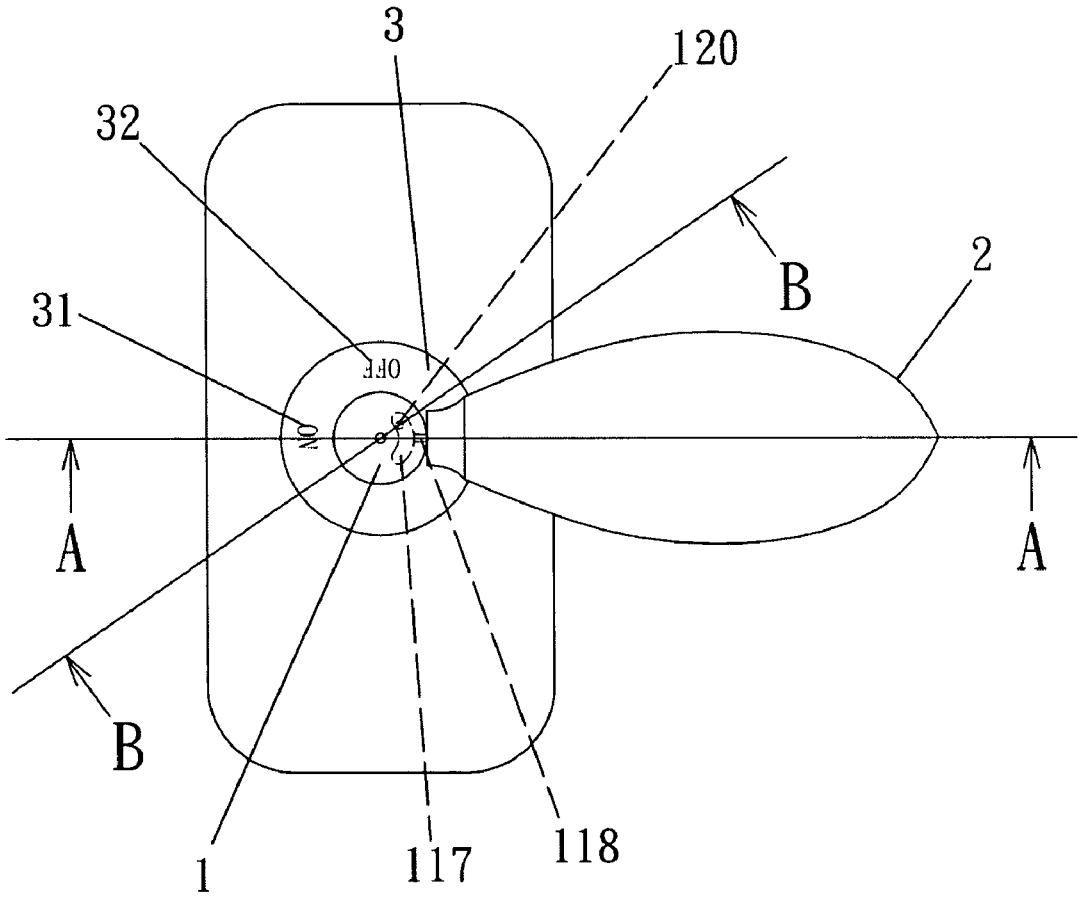
FIG. 4 is the top view showing the operation of the "ON status" for the present invention.
Figure 5:
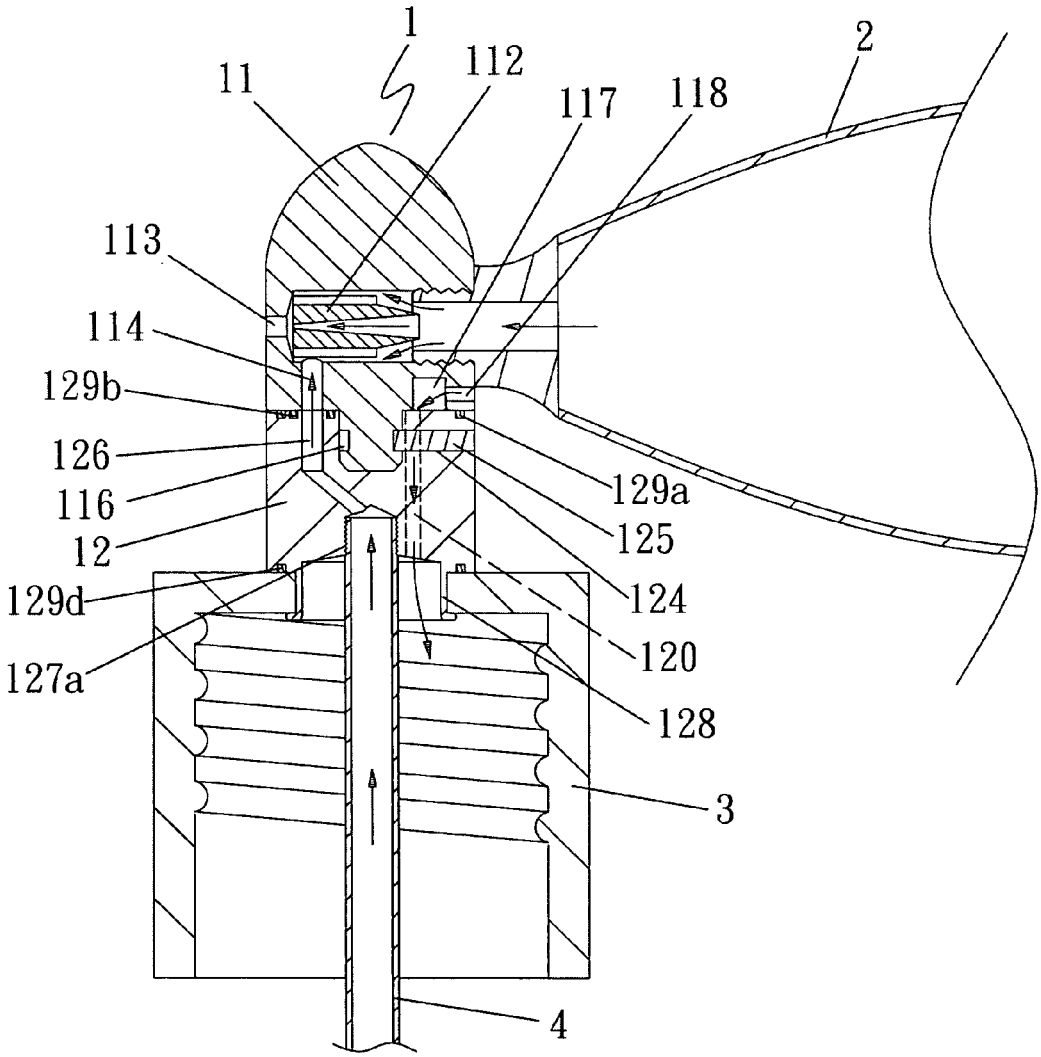
FIG. 5 is the cross section schematic view taken along the line A-A of the previous FIG. 4.
Figure 6:
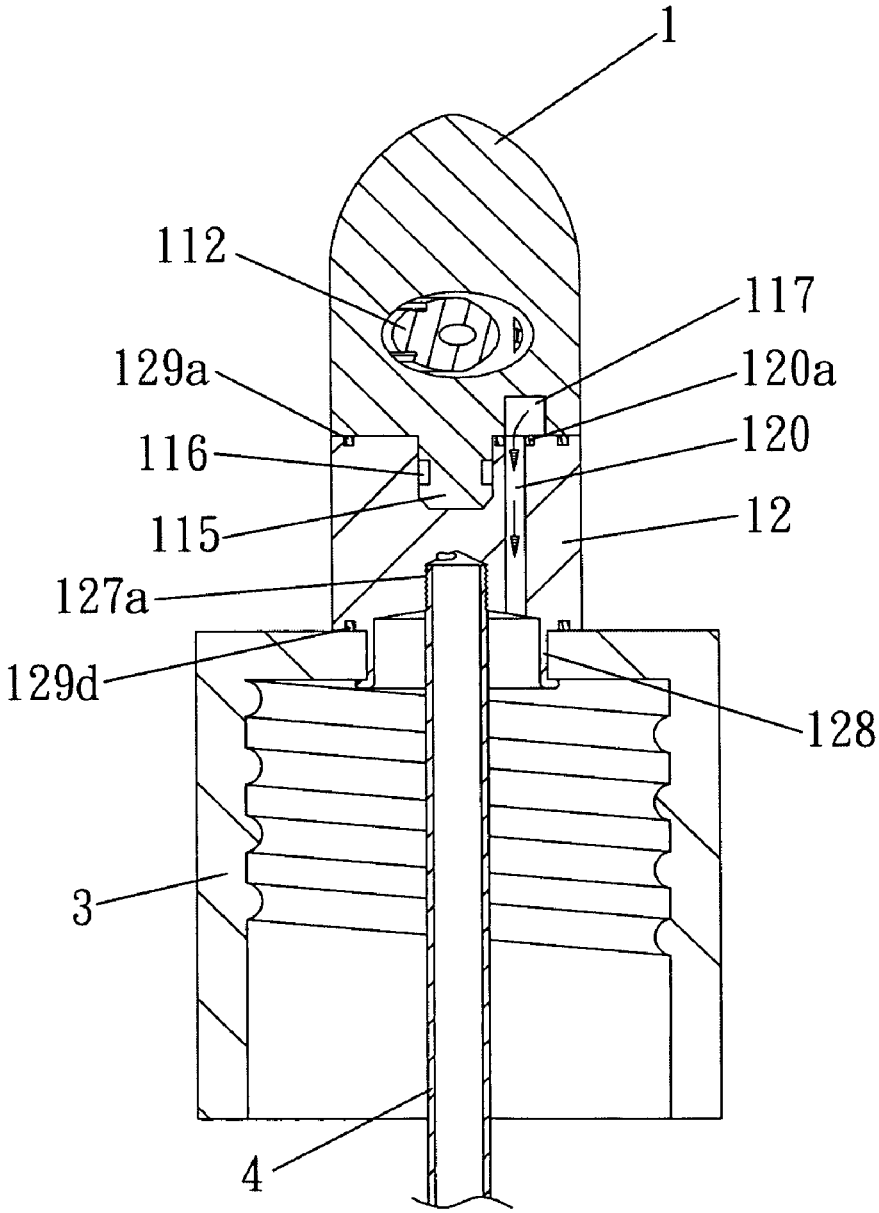
FIG. 6 is the cross section schematic view taken along the line B-B of the previous FIG. 4.

To initiate the use of the "perfume spray head with leakproof feature" for the present invention, please refer to FIGS. 4 through 6. When the spraying unit 11 of the spray head 1 is turned by the user up to the position where the nozzle 113 in alignment with the mark "ON" 31 on the mounting cap 3, the flow passage 114 in the spraying unit 11 aligns with the flow path 126 in the annular pad 12 so that both of the flow passage 114 and flow path 126 become communicable in united link manner. Thereby, the open top end of the air intake passage 120 on the annular pad 12 communicates with the air inlet 118 in the spraying unit 11 via the curved anchoring trough 117 in this specific condition to let ambient air out of the spray head 1 be entered into the curved anchoring trough 117 via the air inlet 118 then circulated into the perfume bottle via the spraying unit 11 and the coupling bushing 128 in the annular pad 12 to pump the liquid perfume therein so that the liquid perfume can circulate along the orderly linking fluid path of the liquid feeding tube 4, the flow path 126 of the annular pad 12, the flow passage 114 and the holding groove 111 of the spraying unit 11. Thus, in the holding groove 111 of the spraying unit 11, the liquid perfume is well mixed with the air from the oval-shaped air inflator 2, which is squeezed by the user at this moment, and ejected out the nozzle 113 into atomized perfume via Venturi effect.

Figure 7:
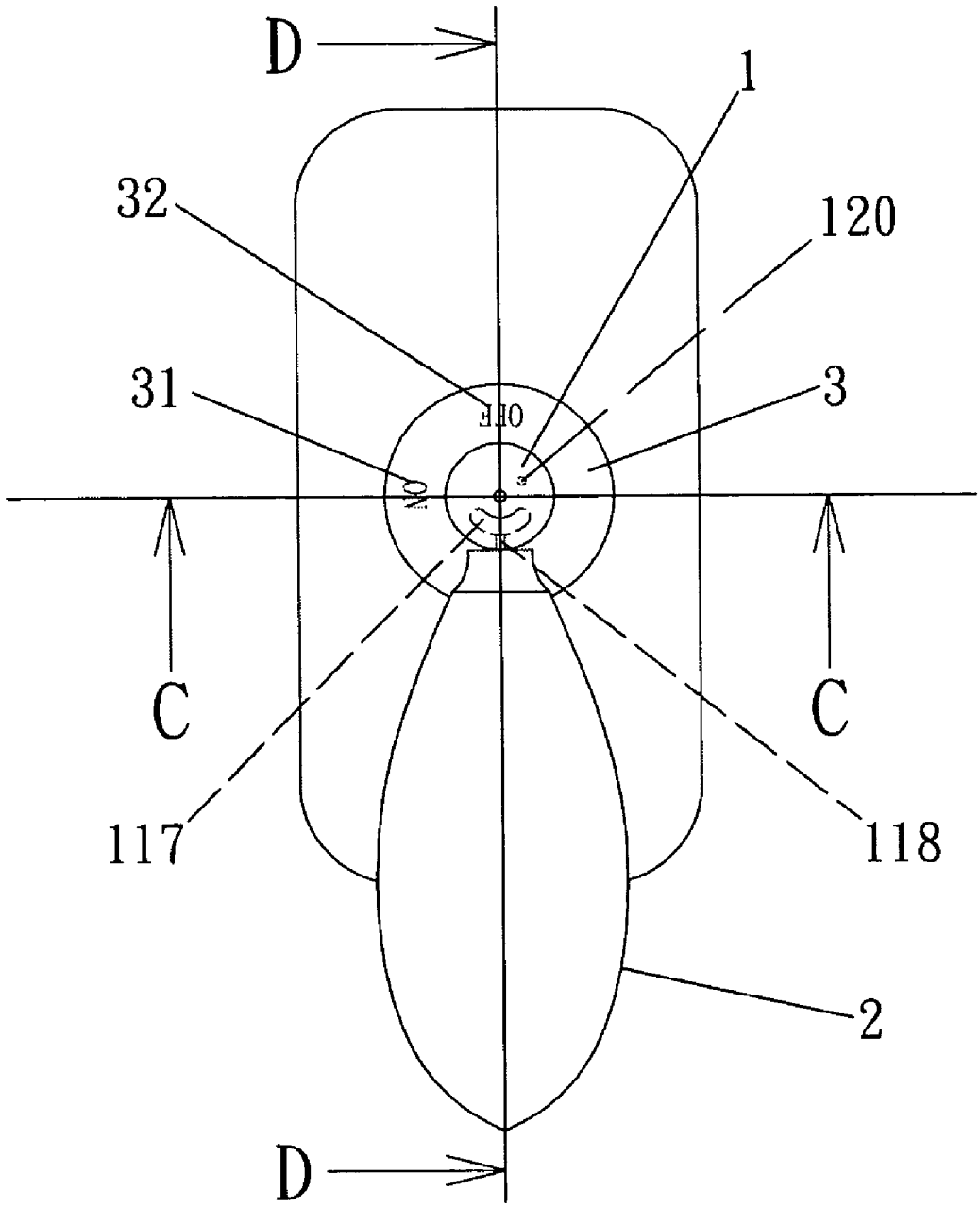
FIG. 7 is the top view showing the operation of the "OFF status" for the present invention.
Figure 8:
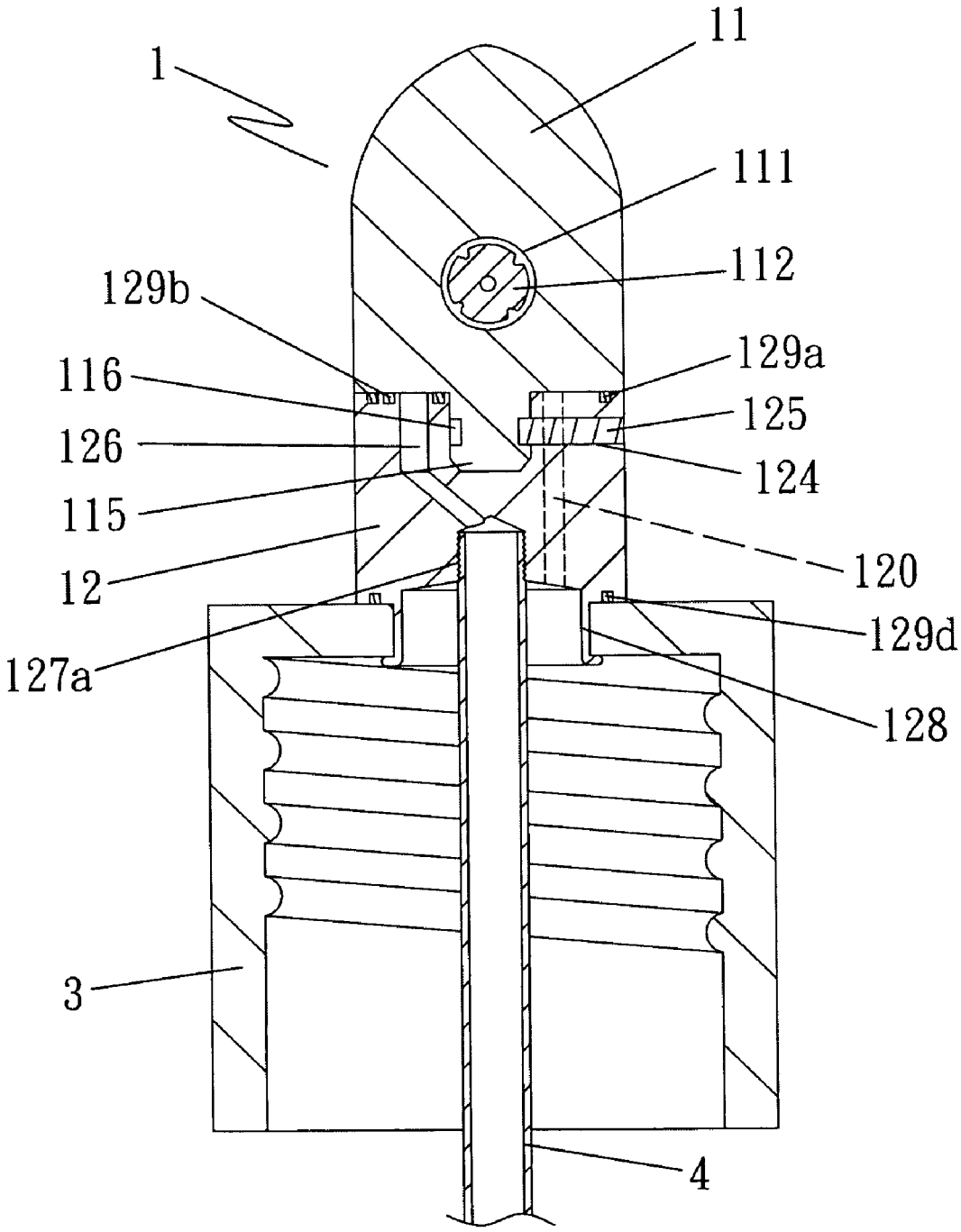
FIG. 8 is the cross section schematic view taken along the line C-C of the previous FIG. 7.
Figure 9:
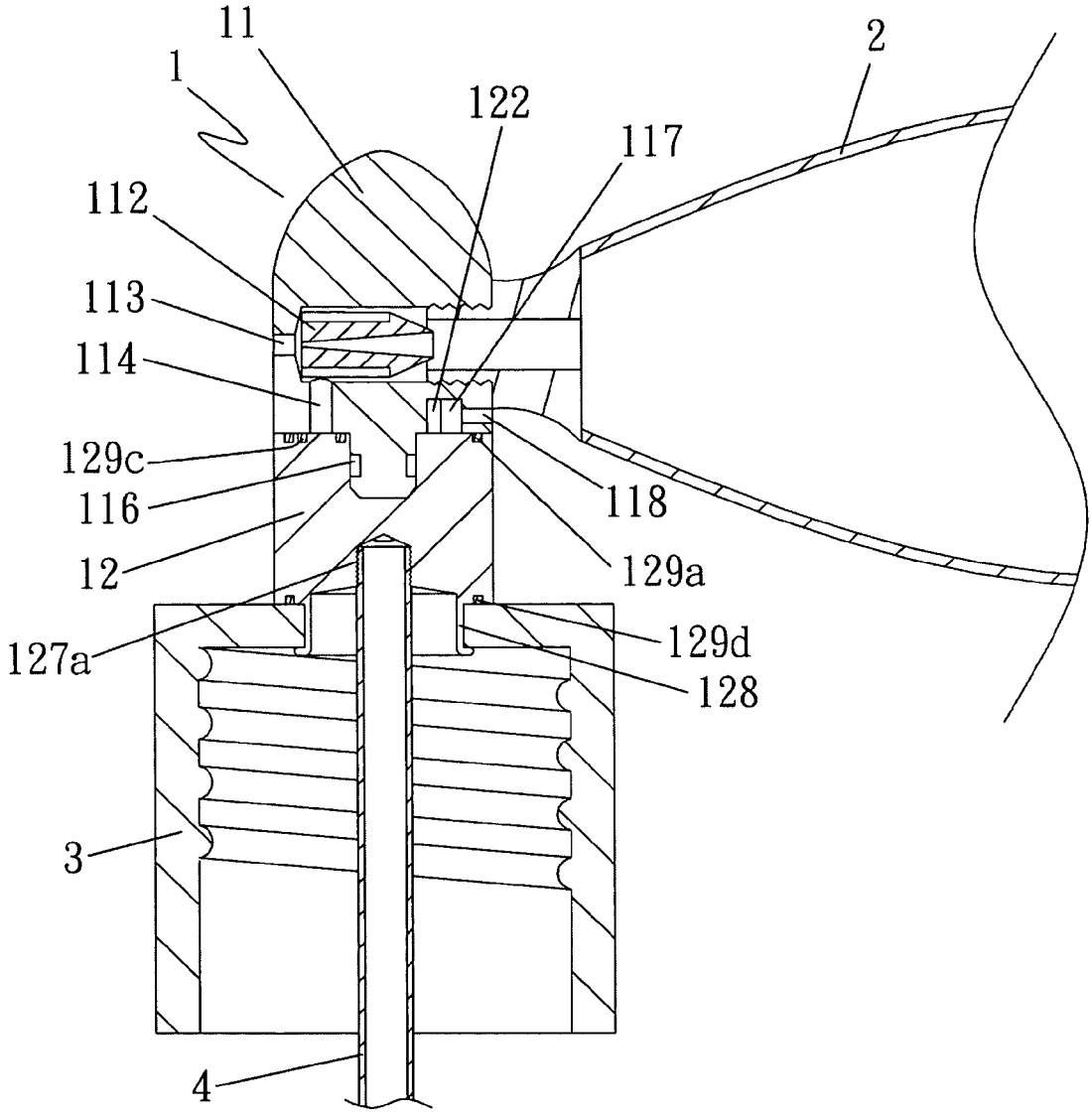
FIG. 9 is the cross section schematic view taken along the line D-D of the previous FIG. 7.

Conversely, to finish the use of the "perfume spray head with leakproof feature" for the present invention, please refer to FIGS. 7 through 9. When the spraying unit 11 of the spray head 1 is turned by the user up to the position where the nozzle 113 in alignment with the mark "OFF" 32 on the mounting cap 3, the flow passage 114 in the spraying unit 11 shifts away and out of the alignment with the flow path 126 in the annular pad 12 so that both of the flow passage 114 and flow path 126 become un-communicable in out of link manner with an included angle of 90° to the central axis for each other. At present, both of the flow passage 114 and flow path 126 become blocked owing to the flow passage 114 in the spraying unit 11 being out of alignment with the leakage-proof washer 129*c* on the annular pad 12 so that the liquid perfume in the perfume bottle can not flow and circulate upwards. Thereby, even the liquid perfume in the bottle is automatically risen upwards along the liquid feeding tube 4 due to certain extrinsic cause, it will be blocked in the flow path 126 of the annular pad 12 without any possibility of getting into the flow passage 114 in the spraying unit 11. Thus, the leakage and overflow of the liquid perfume can be completely avoided. Besides, the air intake passage 120 is also blocked because the open top end of the air intake passage 120 on the annular pad 12 is in a position out of the coverage of the curved anchoring trough 117 so that the no ambient air can enter into the perfume bottle via air inlet 118 to pump the liquid perfume upwards. Thus, in the holding groove 111 of the spraying unit 11, no liquid perfume can be mixed with the air from the oval-shaped air inflator 2 even being squeezed by the user at this moment so that only ambient air is ejected out the nozzle 113 without any atomized perfume.

From the disclosure heretofore, the existing advantages and effects of the present invention are described as below:

1. Simplification of the Components and Structure:

Comparing to the conventional prior arts, the quantity and structure of the components used in the present invention are decreased and simplified so that not only the material preparation and assembly process can be conveniently handled but also the material and handling cost can be significantly reduced. Thus, it has desirable advancement for the industry.

2. Effectively Prevention the Perfume from Leakage:

Because the perfume in the bottle is blocked in the OFF status due to rotational switching contrivance between the spraying unit and the annular pad, the effect of the leakproof is substantially achieved. Moreover, the effect in preventing the perfume overflow and leakage can be enhanced in consequence of the improving sealing function due to multiple leakage-proof washers in the annular pad.

In conclusion, the structural features disclosed in the present invention, which do achieve the expected objects and effects, and have practical value and property of advancement that means the present invention meets the basic patentability criterion of novelty, non-obviousness and practical industrial usage. Accordingly, we submit the patent application in accordance with the related patent laws for your perusal and examination with expectation and appeal for approving us a patent grant, which will be greatly appreciated by us. However, all the disclosure and illustrations heretofore are only the exemplary preferred embodiments, which are not intended for limiting the range of the embodiment for the present invention. Therefore, any equivalent alteration or modification, which does not depart from the claim range and specification essence of the present invention, should be reckoned as in the claim range of the present invention.

What is claimed is:

1. A perfume spray head with leakproof feature comprises a spraying unit and an annular pad, wherein:

The spraying unit has an internal horizontal holding groove with an inside aerator, a horizontal nozzle and a vertical flow passage created therein, a protrudent docking stem with a locking dented ring disposed at the central bottom side thereof as well as a curved anchoring trough and an air inlet configured at the bottom side thereof, wherein the nozzle is formed at the front end of the spraying unit, the vertical flow passage is created inside of the spraying unit, the curved anchoring trough is dented along the inside margin at the bottom side of the spraying unit, and the air inlet is configured at the rear end of the spraying unit in opposite corresponding with the nozzle; and The annular pad has an anchoring hole with an inside anchoring pin created on the top side thereof, a docking pit created in the central top side thereof, a perforated positioning hole with an inside positioning and locking pin disposed at the lateral wall thereof in connection with the docking pit, a vertical air intake passage and a vertical flow path connected with a liquid feeding channel created inside thereof, as well as a coupling bushing disposed at the bottom side thereof, wherein the anchoring pin inserts into the anchoring hole with its top end protruding outside, the docking pit is served for accommodating the protrudent docking stem, the flow path is connected with downward liquid feeding channel, and the vertical air intake passage is created between the anchoring pin and the flow path such that its open top end joints with the curved anchoring trough while its lower end is connected with the inside of the coupling bushing;

By combination of the spraying unit and annular pad, the spray head is switched into "ON status" when the spraying unit is turned to the position where the flow passage of the spraying unit is in alignment with the flow path of the annular pad, while the spray head is switched into "OFF status" when the spraying unit is turned to the position where the flow passage of the spraying unit is out of alignment with the flow path of the annular pad.

2. The perfume spray head with leakproof feature is recited and claimed in the claim 1, wherein the curved anchoring trough is dented along the inside margin at the bottom side of the spraying unit with an included angle of 90° to the central axis.

3. The perfume spray head with leakproof feature is recited and claimed in the claim 1, wherein in the annular pad, on the peripherals of the top side and the bottom side thereof, on the inlet peripheral of the flow path as well as on the top end peripheral of the air intake passage, a leakage-proof washer are inset respectively; particularly at the included angle 90° position away the inlet of the flow path, where the flow passage is turned out of alignment with the flow path, a leakage-proof washer insets thereon.

4. The perfume spray head with leakproof feature is recited and claimed in the claim 1, wherein beneath the bottom side of the annular pad is further disposed a mounting cap, which has a mark "ON" and a mark "OFF" engraved on the top surface thereof with an included angle of 90° to the central axis in corresponding to the two end anchoring positions of the curved anchoring trough.

5. The perfume spray head with leakproof feature is recited and claimed in the claim 1, wherein a liquid feeding tube is further disposed in the inner top wall of the annular pad; and in the inner wall of the liquid feeding channel is further created an internal female thread for being forcibly driven into therein by the liquid feeding tube in combination manner.

* * * * *